US009201391B2

(12) United States Patent
Yoshikawa

(10) Patent No.: US 9,201,391 B2
(45) Date of Patent: Dec. 1, 2015

(54) IMAGE FORMING APPARATUS

(71) Applicant: Brother Kogyo Kabushiki Kaisha, Nagoya-shi, Aichi-ken (JP)

(72) Inventor: Masanari Yoshikawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/530,105

(22) Filed: Oct. 31, 2014

(65) Prior Publication Data

US 2015/0050047 A1 Feb. 19, 2015

Related U.S. Application Data

(63) Continuation of application No. 13/626,115, filed on Sep. 25, 2012, now Pat. No. 8,879,947.

(30) Foreign Application Priority Data

Nov. 29, 2011 (JP) ..... 2011-260834
May 28, 2012 (JP) ..... 2012-121300

(51) Int. Cl.
*G03G 21/16* (2006.01)
*G03G 15/16* (2006.01)
*G03G 21/12* (2006.01)

(52) U.S. Cl.
CPC ..... *G03G 21/169* (2013.01); *G03G 15/161* (2013.01); *G03G 21/12* (2013.01); *G03G 2215/0132* (2013.01)

(58) Field of Classification Search
None
See application file for complete search history.

(56) References Cited

U.S. PATENT DOCUMENTS 5,617,195 A 4/1997 Torimaru et al.

FOREIGN PATENT DOCUMENTS

JP 2008-292879 A 12/2008
JP 2010-101990 A 5/2010

*Primary Examiner* — Clayton E Laballe
*Assistant Examiner* — Jas Sanghera
(74) *Attorney, Agent, or Firm* — Banner & Witcoff, Ltd.

(57) ABSTRACT

An image forming apparatus is configured to form an image by using photosensitive drums. The image forming apparatus includes an apparatus main body, an endless belt, a drawing member which rotatably supports cartridges, and is movable to a mounting position at which the photosensitive drums oppose the endless belt and to a separation position at which the photosensitive drums are further spaced from the endless belt than at the mounting position, and a cleaning unit including a first housing having a collecting member which is configured to contact the endless belt to collect developer on the endless belt and a second housing having an accommodating part which is configured to accommodate the developer collected by the collecting member. The first housing is provided to the apparatus main body and the second housing is provided to the drawing member.

20 Claims, 18 Drawing Sheets

IMAGE FORMING APPARATUS

CROSS-REFERENCE TO RELATED APPLICATION

This application is a continuation of prior U.S. application Ser. No. 13/626,115, filed Sep. 25, 2012, which claims priority from Japanese Patent Application No. 2011-260834, filed on Nov. 29, 2011 and Japanese Patent Applicant No. 2012-121300, filed on May 28, 2012, the entire subject matter of which is incorporated herein by reference.

TECHNICAL FIELD

Aspects of the present invention relate to an image forming apparatus including an endless belt provided in an apparatus main body, a plurality of photosensitive drums provided to oppose the endless belt, and a cleaning unit for collecting developer on the endless belt.

BACKGROUND

There has been known an image forming apparatus of an electrophotographic type including a cleaning unit which collects developer attached on an endless belt which contacts a plurality of photosensitive drums (for example, refer to JP-A-2010-101990).

Specifically, the photosensitive drums are supplied with developer from a plurality of developing cartridges which are provided for the plurality of photosensitive drums, respectively. The photosensitive drums are held by a drum holding member which can be drawn relative to an apparatus main body. Also, the developing cartridges are held by a developing cartridge holding member which can be drawn relative to the apparatus main body.

The cleaning unit has a collecting member which contacts the endless belt to thus collect the developer attached on the endless belt, and an accommodating part which accommodates the developer collected by the collecting member. The collecting member is held to the drum holding member, and the accommodating part is held to the developing cartridge holding member, which facilitate replacement of the cleaning unit.

SUMMARY

In the above technique, in order to surely collect developer on the endless belt, the collecting member is required to be positioned relative to the endless belt to contact it by an appropriate pressure. However, since the collecting member is held by the drum holding member which is movable relative to the apparatus main body, it is difficult to precisely position the collecting member relative to the endless belt.

Accordingly, it is an aspect of the present invention to provide an image forming apparatus capable of replacing an accommodating part while precisely positioning a collecting member of a cleaning unit relative to an endless belt.

According to an illustrative embodiment of the present invention, there is provided an image forming apparatus configured to form an image by using a plurality of photosensitive drums. The image forming apparatus includes an apparatus main body, an endless belt, a drawing member, and a cleaning unit. The endless belt is provided in the apparatus main body. The drawing member which rotatably supports a plurality of cartridges, and is movable among a mounting position at which the drawing member is mounted in the apparatus main body and the plurality of photosensitive drums oppose the endless belt, a separation position which is located at an inner side of the apparatus main body and at which the photosensitive drums are more spaced from the endless belt than at the mounting position, and an outer position which is located at an outer side of the apparatus main body than the separation position. The cleaning unit includes a collecting member which is configured to contact the endless belt to collect developer on the endless belt, and an accommodating part which is configured to accommodate therein the developer collected by the collecting member. The cleaning unit includes a first housing having the collecting member, and a second housing having the accommodating part. The first housing is provided to the apparatus main body and includes a first opening, and a first opening and closing member which is configured to open and close the first opening. The second housing is provided to the drawing member and includes a second opening which opposes the first opening to allow the first housing and the second housing to communicate with each other when the drawing member is located at the mounting position, and a second opening and closing member which is configured to open and close the second opening. The first opening and closing member and the second opening and closing member are configured to close the first opening and the second opening while the drawing member is moved from the mounting position to the separation position, and configured to open the first opening and the second opening while the drawing member is moved from the separation position to the mounting position.

According to the above configuration, it is possible to replace the accommodating part while precisely positioning the collecting member of the cleaning unit relative to the endless belt.

BRIEF DESCRIPTION OF THE DRAWINGS

The above and other aspects of the present invention will become more apparent and more readily appreciated from the following description of illustrative embodiments of the present invention taken in conjunction with the attached drawings, in which.

DETAILED DESCRIPTION

Overall Configuration of Color Printer

Hereinafter, an illustrative embodiment of the present invention will be specifically described with reference to the drawings. In the below descriptions, an overall configuration of a color printer 1 which is an example of the image forming apparatus will be first described and then respective parts of the apparatus will be specifically described.

In the below descriptions, directions are described based on a user who is using the color printer 1. That is, the left side of FIG. 1 is referred to as the 'front', the right side is referred to as the 'rear', the front side is referred to as the 'right' and the back side is referred to as the 'left.' Also, the upper-lower direction of FIG. 1 is referred to as the 'upper-lower.'

Figure 1:
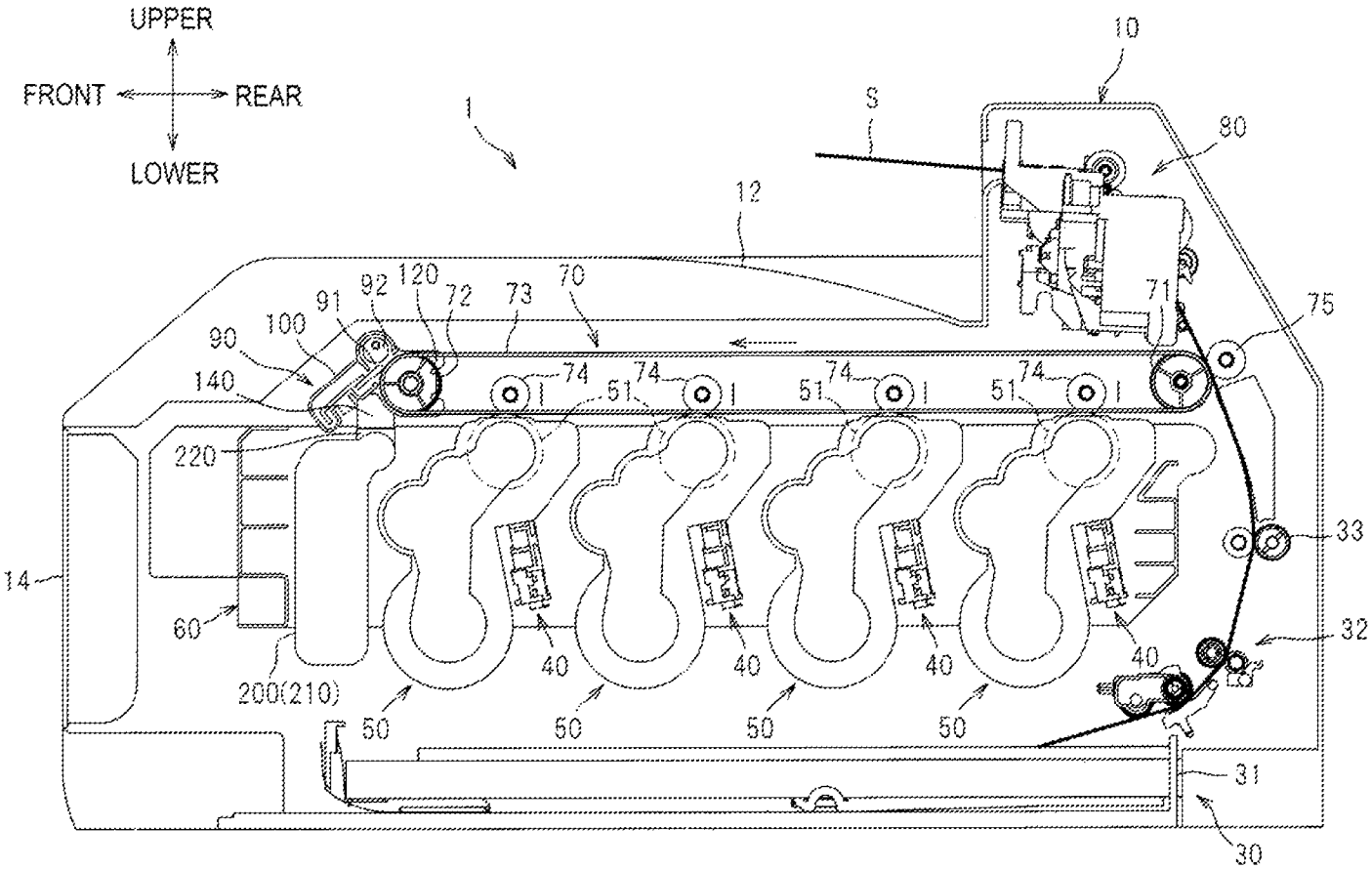
FIG. 1 is a sectional view showing a schematic configuration of a color printer according to an illustrative embodiment of the present invention.

As shown in FIG. 1, the color printer 1 includes, in an apparatus main body 10, a feeder unit 30, four LED units 40, four process cartridges 50, a holder 60 (an example of a drawing member), a transfer unit 70, a fixing unit 80 and a cleaning unit 90.

Figure 2:
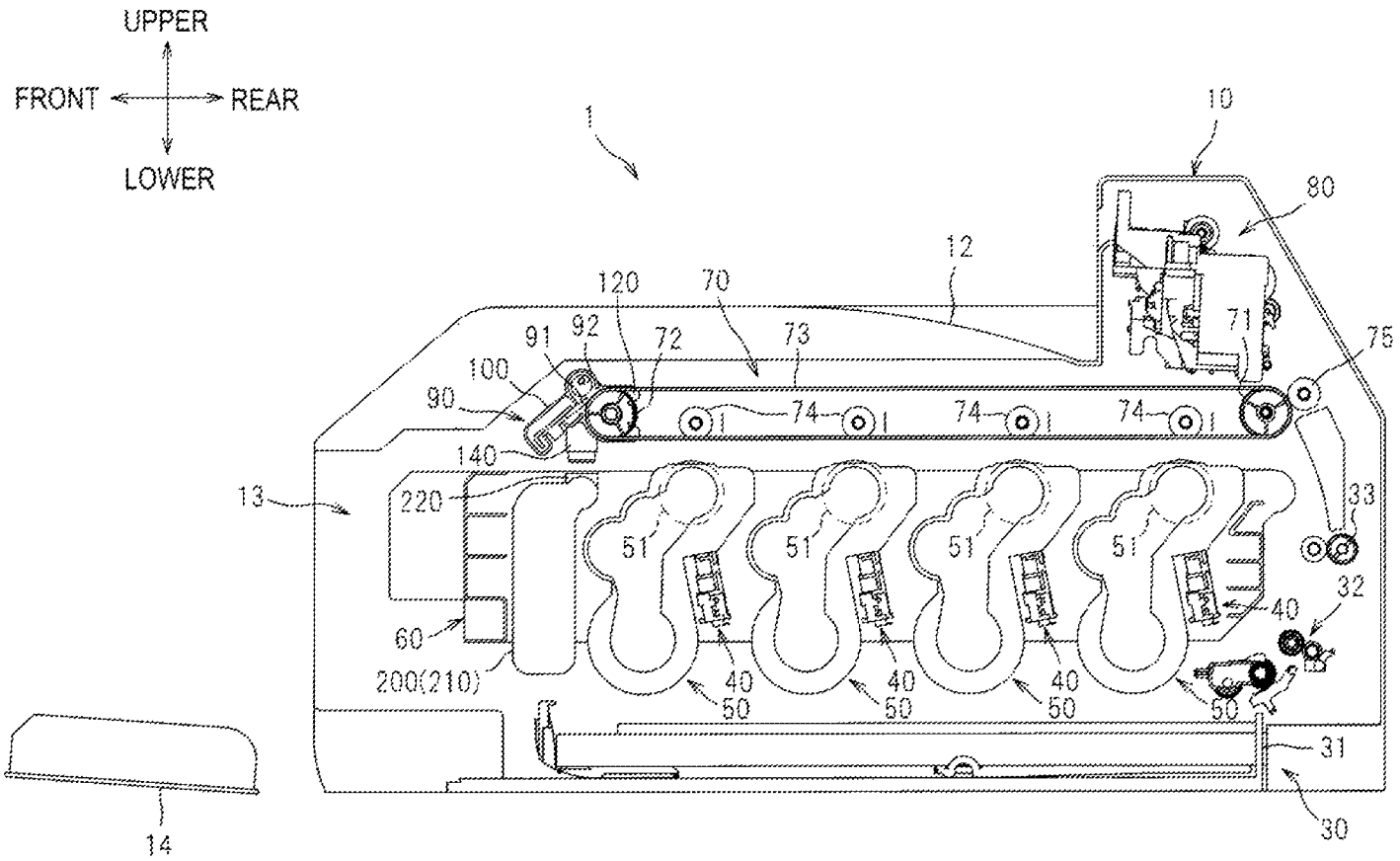
FIG. 2 shows a state where a holder is located at a separation position.

An upper part of the apparatus main body 10 is provided with a sheet discharge tray 12 on which a sheet S discharged from the apparatus main body 10 is placed. Also, a front wall of the apparatus main body 10 is formed with an opening 13 (refer to FIG. 2) for drawing the holder 60 out of the apparatus main body 10 and is provided with a front cover 14 to be rotatable for opening and closing the opening 13.

The feeder unit 30 is provided at a lower part in the apparatus main body 10 and has a sheet feeding tray 31 which accommodates therein the sheets S and a sheet feeding mechanism 32 having a plurality of pairs of conveyance rollers 33 conveying the sheet S from the sheet feeding tray 31 to a transfer position (between an endless belt 73 and a secondary transfer roller 75). The sheets S in the sheet feeding tray 31 are separated one-by-one by the sheet feeding mechanism 32, which is then conveyed to the transfer position.

The LED units 40 are provided to correspond to respective photosensitive drums 51 and have a plurality of light emitting units (LEDs) (not shown) at parts opposing the photosensitive drums 51. The LED units 40 turn on and off the light emitting units to thus expose surfaces of the photosensitive drums 51 uniformly charged by chargers, thereby forming electrostatic latent images on the photosensitive drums 51 based on image data.

The process cartridges 50 are aligned in the front-rear direction above the feeder unit 30 and have the photosensitive drum 51, a charger, a developing roller, a supply roller, a layer thickness regulation blade, a toner accommodation chamber and the like, respectively, which are not shown.

Figure 3:
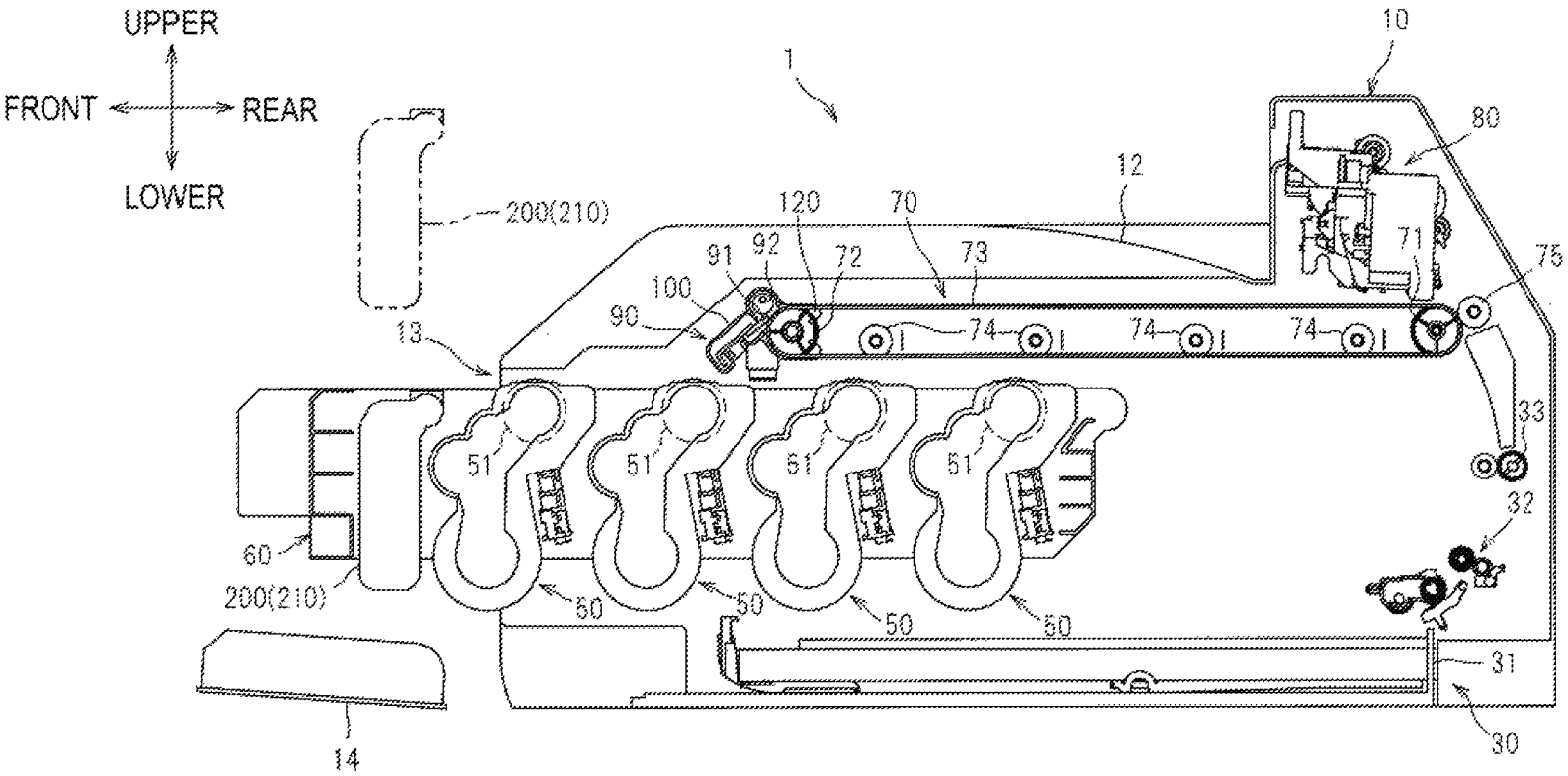
FIG. 3 shows a state where the holder is located at an outer position.

The holder 60 collectively holds the four process cartridges 50 and a second housing 200 of the cleaning unit 90. The holder 60 is supported to the apparatus main body 10 to be movable in the front-rear direction. Specifically, the holder 60 is mounted to the apparatus main body 10 and is configured to move to a mounting position (refer to FIG. 1) at which the photosensitive drums 51 are provided to oppose the endless belt 73, a separation position (refer to FIG. 2) at which the respective photosensitive drums 51 are more spaced from the endless belt 73 than at the mounting position, and an outer position (refer to FIG. 3) which is located at an outer side of the apparatus main body 10 than the mounting position or the separation position.

A mechanism for moving the holder 60 among the mounting position, the separation position and the outer position may be a mechanism including a rail which movably supports the holder in the front-rear direction and a lift mechanism which vertically moves the rail, or may be a mechanism including a rail which extends in the front-rear direction and has a rear end bent to extend obliquely upward as proceeding rearward, and the like.

The transfer unit 70 is provided above the process cartridges 50 (photosensitive drums 51) and has a driving roller 71 (an example of a first roller), a driven roller 72 (an example of a second roller), the endless belt 73 wound around the driving roller 71 and the driven roller 72, four primary transfer rollers 74 provided to oppose the photosensitive drums 51 via the endless belt 73 and a secondary transfer belt 75 provided to oppose the driving roller 71 via the endless belt 73.

In the transfer unit 70, the driven roller 72 is spaced from the driving roller 71 and is urged by an urging member (not shown) in a direction separating from the driving roller 71 such that the endless belt 73 wound around the driving roller 71 and the driven roller 72 would not cause flexure.

In the process cartridges 50 and the transfer unit 70, the surfaces of the photosensitive drums 51 are uniformly charged by the chargers and then exposed by the LED units 40, so that the electrostatic latent image based on the image data are formed on the photosensitive drums 51. Also, the toner (developer) in the toner accommodation chamber is carried on surfaces of the developing rollers via the supply rollers.

The toner carried on the surfaces of the developing rollers is supplied from the developing rollers to the electrostatic latent images on the photosensitive drums 51. Thereby, the electrostatic latent images become visible, so that toner images are formed (carried) on the photosensitive drums 51. The toner images having respective colors formed on the respective photosensitive drums 51 are sequentially overlapped and transferred onto the endless belt 73. The sheet S conveyed from the feeder unit 30 passes between the endless belt 73 and the secondary transfer roller 75, so that the toner images on the endless belt 73 are transferred onto the sheet S.

The fixing unit 80 is provided above the transfer unit 70 and has a heating roller (not shown), a pressing roller (not shown) which is provided to oppose the heating roller and presses the heating roller, and discharge rollers (not shown) which discharge the fixed sheet S to the outside of the apparatus main body 10. In the fixing unit 80, the sheet S having the toner images transferred thereto passes between the heating roller and the pressing roller, and the toner images are thus heat-fixed. Then, the sheet is discharged to the outside of the apparatus main body 10 by the discharge rollers and is then placed on the sheet discharge tray 12.

The cleaning unit 90 is a mechanism which collects the toner remaining on the endless belt 73. A part (blade 91) of the cleaning unit is provided to contact a portion of the endless belt at a downstream side than the secondary transfer roller 75 in a rotating direction of the endless belt 73 and at an upstream side than the photosensitive drums 51 in the rotating direction.

In the cleaning unit 90, the toner which remains on the endless belt 73 without being transferred onto the sheet S between the endless belt 73 and the secondary transfer roller 75 is collected by the blade 91.

Detailed Configuration of Cleaning Unit

In the below, a detailed configuration of the cleaning unit 90 is described.

Figure 4:
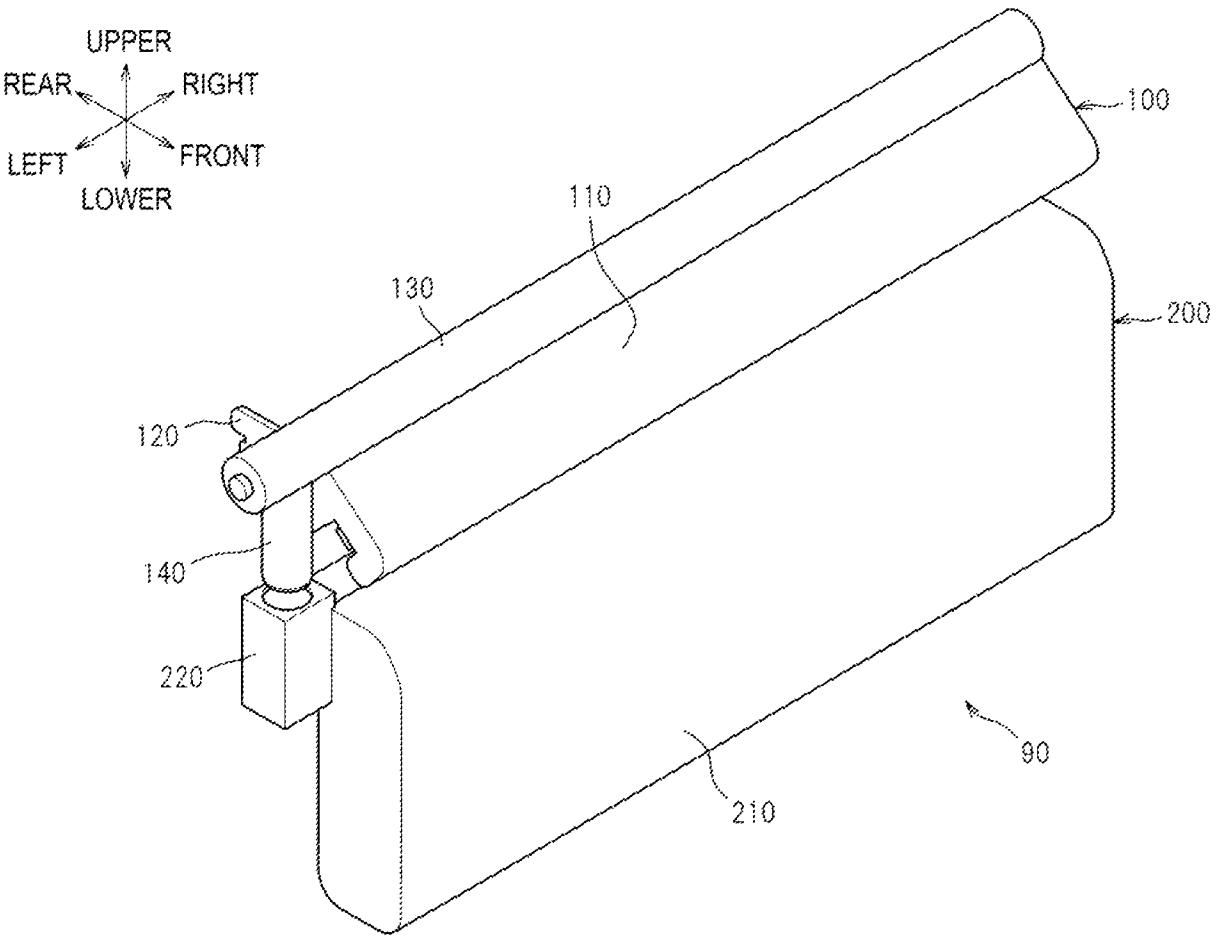
FIG. 4 is a perspective view of a cleaning unit.

As shown in FIGS. 1 and 4, the cleaning unit 90 has the blade 91, an auger 92, a first housing 100 and a second housing 200.

The blade 91 is a plate-shaped member which is long in the left-right direction and a tip of the blade is configured to contact the surface of the endless belt 73 and to thus collect the toner on the endless belt 73.

The first housing 100 supports a base end portion of the blade 91 and is provided to the apparatus main body 10. The first housing 100 has a first communication part 140. The first communication part 140 is connected to the second housing 200, so that the first housing sends the toner collected by the blade 91 to the second housing 200.

The second housing 200 has a waste toner accommodating part 210 (an example of an accommodating part) which accommodates the toner collected by the blade 91, and a second communication part 220. The second housing 200 is provided to the holder 60. When the holder 60 is located at the mounting position, the second housing is positioned below the first housing 100 and the second communication part 220 is connected to the first communication part 140. When the holder 60 is moved from the mounting position to the separation position, the connection of the second communication part 220 and the first communication part 140 is released (refer to FIG. 2).

That is, the first housing 100 which supports the blade 91 is provided to the apparatus main body 10, and the second housing 200 which has the waste toner accommodating part 210 is provided to the holder 60. Therefore, it is possible to draw the waste toner accommodating part 210 together with the holder 60 out of the apparatus main body 10 while the blade 91 is fixed relative to the endless belt 73. That is, it is possible to replace the waste toner accommodating part 210 while precisely positioning the blade 91 relative to the endless belt 73. In the below, the specific configuration of the cleaning unit 90 is described.

The first housing 100 is a frame which supports the blade 91, the auger 92 and the driven roller 72, and is provided at the front of the endless belt 73 in the apparatus main body 10. Specifically, the first housing 100 has a blade holding part 110, driven roller holding parts 120, an auger holding part 130, and the first communication part 140.

The blade holding part 110 has a box shape which is opened at obliquely rear-upper portion, and supports the base end portion of the blade 91 such that the tip of the blade 91 is exposed to the outside through the opened part.

The driven roller holding parts 120 have a flat plate shape and are provided at both left and right ends of the first housing 100 (only one is shown). Also, the driven roller holding parts 120 rotatably support the driven roller 72 of the transfer unit 70. That is, the blade 91 is provided to a member (first housing 100) which holds the driven roller 72. Also, the driven roller holding parts 120 support the driven roller 72 so as to sandwich the endless belt 73 with the blade 91. Accordingly, the position of the blade 91 relative to the endless belt 73 is hard to vary.

Figure 5:
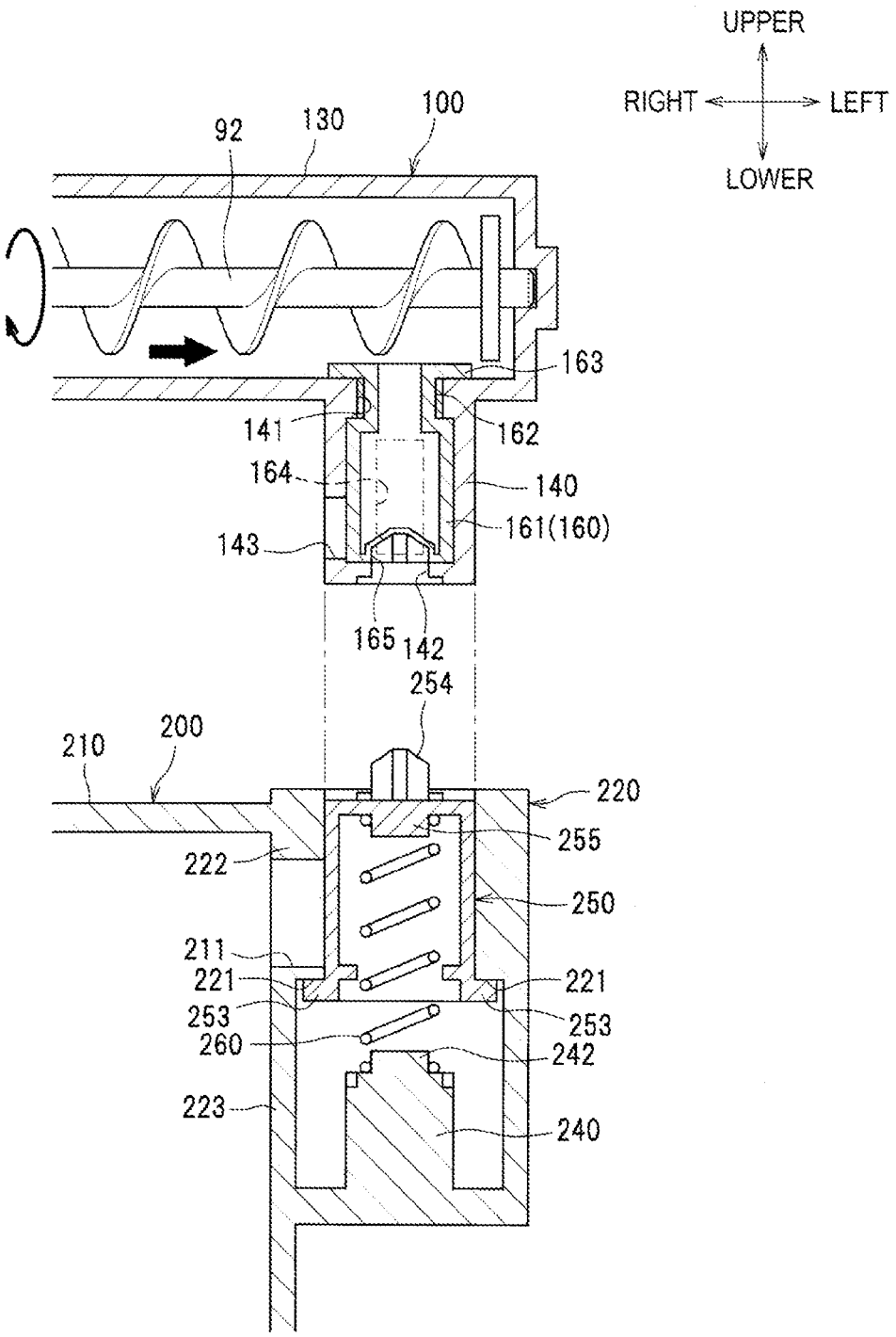
FIG. 5 is a sectional view showing a communicating part between a first housing and a second housing when the drawer is located at the separation position.

The auger holding part 130 is provided above the tip of the blade 91 and has a cylindrical shape which is long in the left-right direction. The cylindrical shape is opened toward the tip of the blade 91, i.e., is opened at a lower part thereof. In the auger holding part 130, the auger 92 is provided, as shown in FIG. 5.

The auger 92 is rotatably supported to the first housing 100 and is provided to extend from a left end to a right end of the auger holding part 130. The auger 92 is configured to rotate and convey the toner, which is collected by the blade 91, toward the left direction (more specifically, the first communication part 140).

As described above, the first communication part 140 is connected to the second housing 200 and is provided at the left end portion of the auger holding part 130. The first communication part 140 has a cylindrical shape having a bottom and extending downward from the lower part of the auger holding part 130.

The first communication part 140 has an upper opening 141 at an upper end thereof, which has a diameter smaller than an inner diameter of the first communication part 140, and communicates with the inside of the auger holding part 130 through the upper opening 141. The first communication part 140 is formed at its bottom part with a lower opening 142 through which an engaging part 254 of a second opening and closing member 250 (described later) is inserted into the first communication part 140. The first communication part 140 is formed with a first opening 143 which penetrates a right side wall (inner wall in a left-right direction) in the left-right direction.

The first communication part 140 is provided with a first opening and closing member 160 which opens and closes the first opening 143.

Figure 6A:
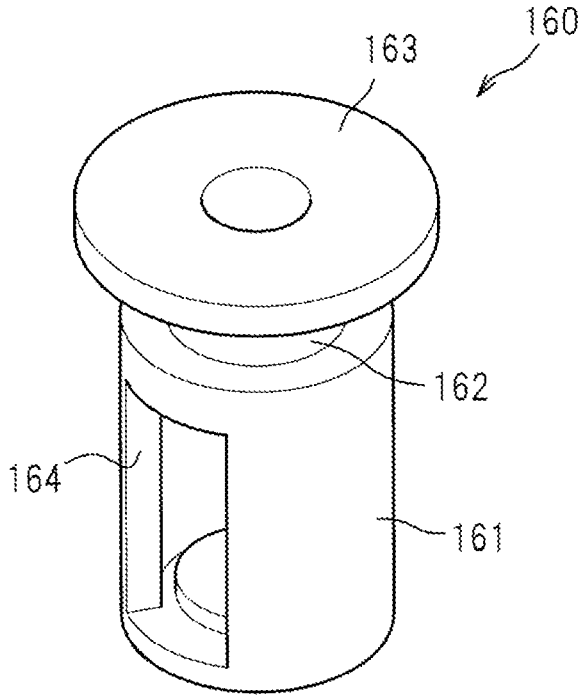
FIGS. 6A and 6B are perspective views showing a first opening and closing member.
Figure 6B:
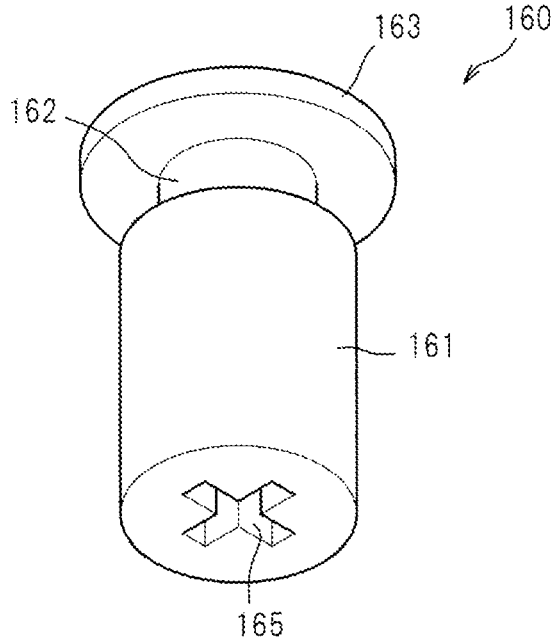

The first opening and closing member 160 is a cylindrical member having a bottom and an opened upper end. As shown in FIGS. 6A and 6B, the first opening and closing member 160 includes a main body part 161, a neck part 162, and a flange part 163.

The main body part 161 has the substantially same outer diameter as the inner diameter of the first communication part 140 and is rotatably supported in the first communication part 140. The main body part 161 is formed with a through-opening 164 at the substantially same position as the first opening 143 of the first communication part 140 in the upper-lower direction when the first opening and closing member 160 is provided in the first communication part 140. Also, the bottom of the main body part 161 is formed with a cross-shaped recess portion 165 at a lower surface thereof. The recess portion 165 is exposed to the outside through the lower opening 142 of the first communication part 140.

The neck part 162 continues to an upper end of the main body part 161 and has an outer diameter smaller than the main body part 161. More specifically, the outer diameter of the neck part 162 is smaller than a diameter of the upper opening 141 of the first communication part 140.

The flange part 163 is formed to expand radially outward from an upper end of the neck part 162. Specifically, the flange part 163 is more expanded outward than the upper opening 141 of the first communication part 140.

As shown in FIG. 5, the first opening and closing member 160 configured as described above is provided such that the main body part 161 is arranged in the first communication part 140 and an end edge of the upper opening 141 of the first communication part 140 is positioned between the main body part 161 and the flange part 163. The first opening and closing member 160 is configured to open the first opening 143 when the opening 164 of the main body part 161 opposes the first opening 143 and configured to close the first opening 143 when a part other than the opening 164 of the main body part 161 opposes the first opening 143. In the meantime, the first opening and closing member 160 closes the first opening 143 at a state where the first communication part 140 is separated from the second communication part 220.

In order to less smoothly rotate the first opening and closing member 160 in the first communication part 140, a sponge (a reference numeral thereof is omitted), for example, is provided in a gap between the upper opening 141 of the first communication part 140 and the neck part 162 of the first opening and closing member 160.

As shown in FIG. 1, the second housing 200 is held at the holder 60 at the front of the four process cartridges 50. As described above, the second housing 200 has the waste toner accommodating part 210 and the second communication part 220.

As shown in FIGS. 4 and 5, the waste toner accommodating part 210 has a substantially rectangular box shape and is configured to accommodate therein the toner scraped off by the blade 91. The waste toner accommodating part 210 is formed with a second opening 211 which penetrates an upper part of a left wall thereof in the left-right direction.

The second communication part 220 is provided at a part where the second opening 211 of the left wall of the waste toner accommodating part 210 is formed. The second communication part 220 has a cylindrical shape having an opened upper part and has a step part 221 at a center portion of an inner periphery in the upper-lower direction.

Specifically, the second communication part 220 has an upper part 222 which is provided above the step part 221 of the inner periphery and has the substantially same inner diameter as the outer diameter of the first communication part 140, and the second opening 211 is formed at the inner side of the upper part 222 in the left-right direction. A lower part 223 which is provided below the step part 221 of the inner periphery has an inner diameter larger than the upper part 222.

In the second communication part 220, a protrusion part 240 which is provided on the bottom of the second communication part 220, a second opening and closing member 250 which opens and closes the second opening 211 and a coil spring 260 are provided.

Figure 7A:
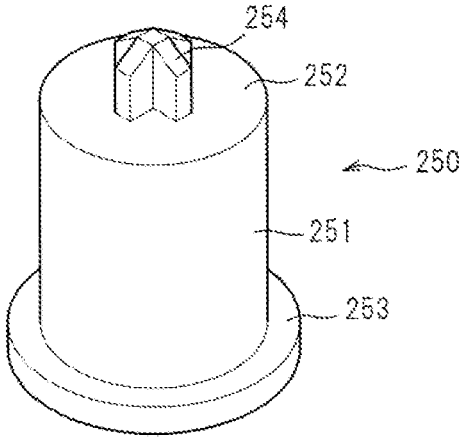
FIG. 7A is a perspective view showing a second opening and closing member.
Figure 7B:
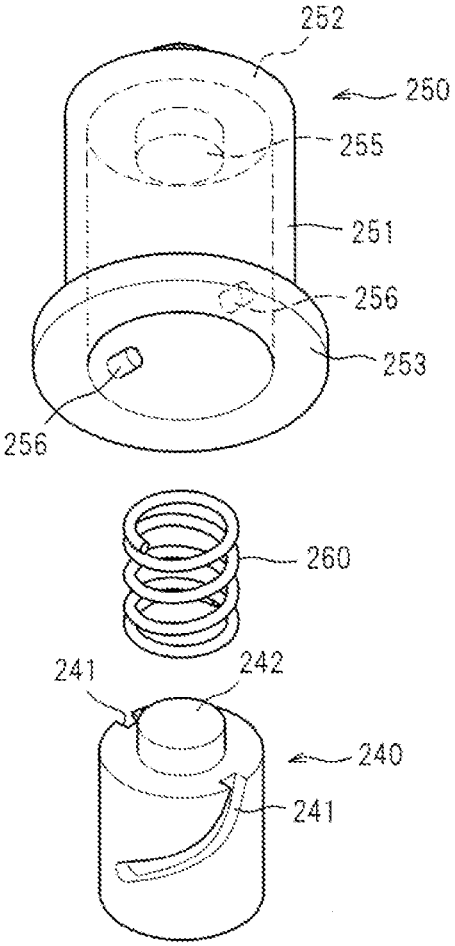
FIG. 7B is a perspective view showing the second opening and closing member, a coil spring and a protrusion part.

As shown in FIG. 7B, the protrusion part 240 has a cylinder shape and extends upward from the bottom of the second communication part 220. The protrusion 240 has a pair of guide recesses 241 and an extension portion 242.

The guide recess 241 is provided on an outer periphery of the protrusion part 240 and extends from an upper end to a substantially center portion in the upper-lower direction. Specifically, the guide recess 241 has a substantial arc shape connecting an upper end and a substantially center portion in the upper-lower direction, which is located at a position 90°-deviated from the upper end in a circumferential direction. The pair of guide recesses 241 is point-symmetrically provided at positions 180°-deviated in the circumferential direction.

The extension portion 242 is a projection extending upward from the upper end of the protrusion part 240 and is configured to penetrate the coil spring 260 and to support a lower end portion of the coil spring 260.

As shown in FIGS. 7A and 7B, the second opening and closing member 250 has a cylindrical part 251, an upper wall 252 which closes an upper end of the cylindrical part 251 and a flange part 253 extending from a lower end of the cylindrical part 251 radially outward.

The upper wall 252 has the engaging part 254 extending upward from an upper surface thereof, and a spring support part 255 protruding downward from a lower surface thereof. The engaging part 254 has a cross shape, when seen from the upper-lower direction, and is tapered upward. The engaging part 254 is fitted into the recess portion 165 of the first opening and closing member 160 when the first communication part 140 enters the second communication part 220 and is brought into contact with the upper wall 252.

The spring support part 255 is a projection which is provided on the lower surface of the upper wall 252. The spring support part 255 is inserted into the coil spring 260 and is supported at the upper end portion of the coil spring 260.

The cylindrical part 251 has the substantially same size as the inner diameter of the upper part 222 of the second communication part 220. Also, the cylindrical part 251 has the substantially same size in the upper-lower direction as the upper part 222 of the second communication part 220 so that it closes the second opening 211 at a state where the flange part 253 is engaged with the step part 221 of the second communication part 220.

An inner periphery of the cylindrical part 251 is provided with a pair of projections 256 protruding inward at a lower part thereof. The respective projections 256 are provided at positions 180°-deviated in the circumferential direction of the cylindrical part 251 so as to oppose each other. The pair of projections 256 is configured to engage with the guide recesses 241 of the protrusion part 240. As the pair of projections 256 is moved along the guide recesses 241, the second opening and closing member 250 is rotated by 90° when moving in the upper-lower direction.

The extension portion 242 of the protrusion part 240 is inserted into one end of the coil spring 260 and the spring support part 255 of the second opening and closing member 250 is inserted into the other end thereof, so that the coil spring 260 is provided between the protrusion part 240 and the second opening and closing member 250 and urges the second opening and closing member 250 upward. Thereby, as shown in FIG. 5, at a state where the first communication part 140 and the second communication part 220 are separated from each other, the second opening and closing member 250 is located above the second communication part 220 by the urging force of the coil spring 260, thereby closing the second opening 211. In the meantime, the upward moving of the second opening and closing member 250 is regulated by the engagement between the flange part 253 of the second opening and closing member 250 and the step part 221 of the second communication part 220.

According to the above illustrative embodiment, following operational effects can be achieved.

When mounting the holder 60 into the apparatus main body 10, the second housing 200 is positioned below the first housing 100 at the separation position. At this time, the first opening and closing member 160 closes the first opening 143 and the second opening and closing member 250 closes the second opening 211.

Figure 8:
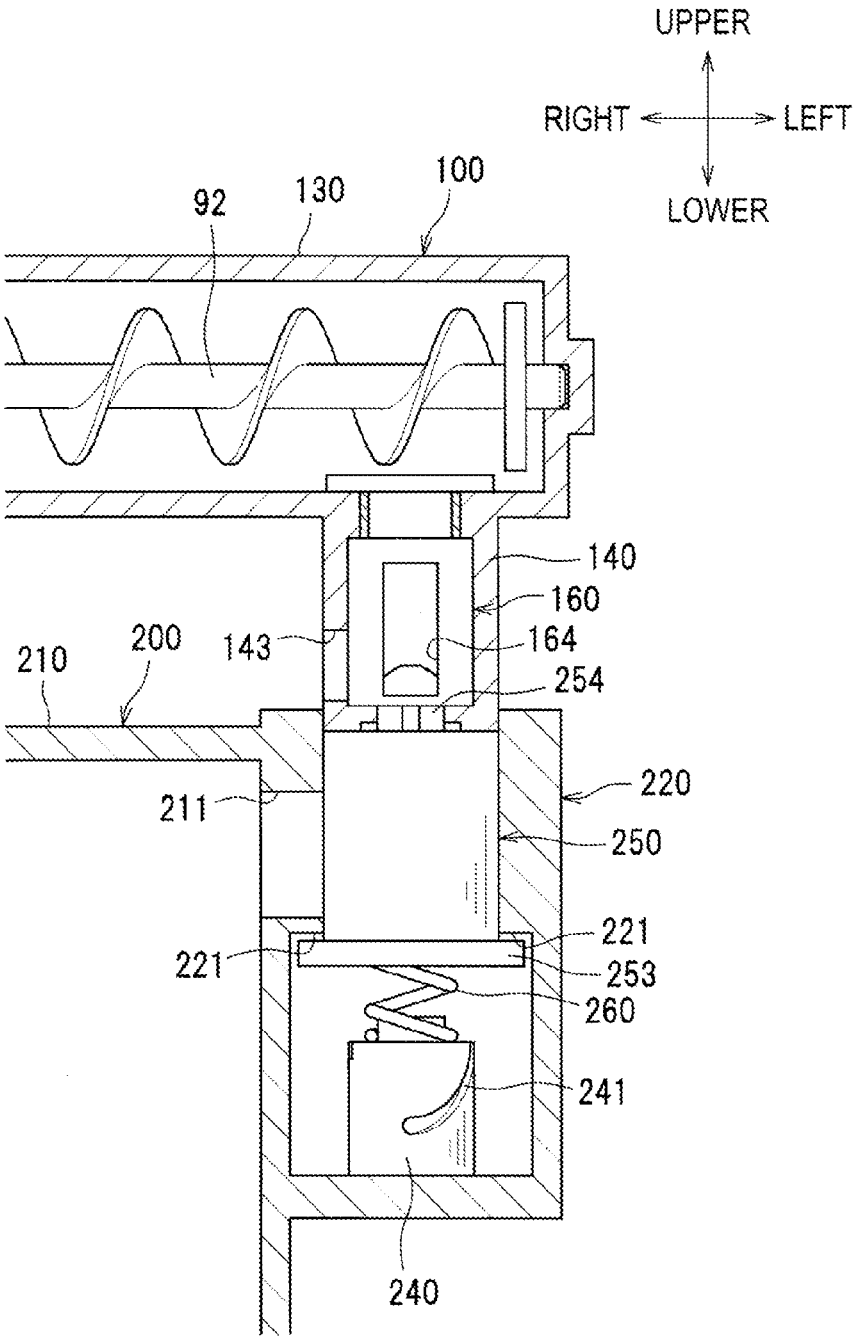
FIG. 8 is a sectional view showing a state where the first opening and closing member and the second opening and closing member close a first opening and a second opening.

When the holder 60 is moved from the separation position to the mounting position, the second housing 200 approaches the first housing 100 from the below. At this time, as shown in FIG. 8, the upper wall 252 of the second opening and closing member 250 is first brought into contact with the bottom of the first communication part 140, so that the engaging part 254 of the second opening and closing member 250 is fitted into the recess portion 165 (refer to FIG. 5) of the first opening and closing member 160.

Figure 9:
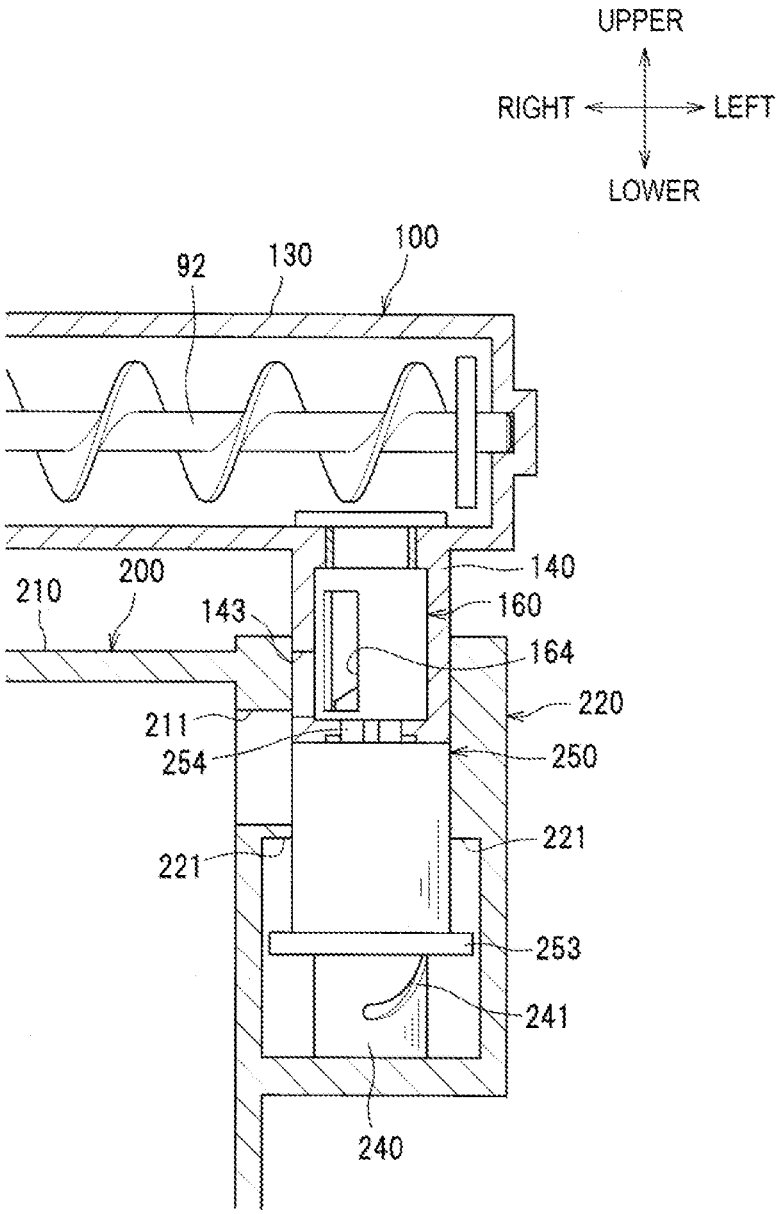
FIG. 9 is a sectional view showing a state where the first opening and closing member closes the first opening and the second opening and closing member opens the second opening.

When the second housing 200 is further moved upward, as shown in FIG. 9, the first communication part 140 enters the second communication part 220, and the second opening and closing member 250 is pushed by the first communication part 140 and is moved downward relative to the second communication part 220. Thereby, the second opening 211 is opened.

Figure 10:
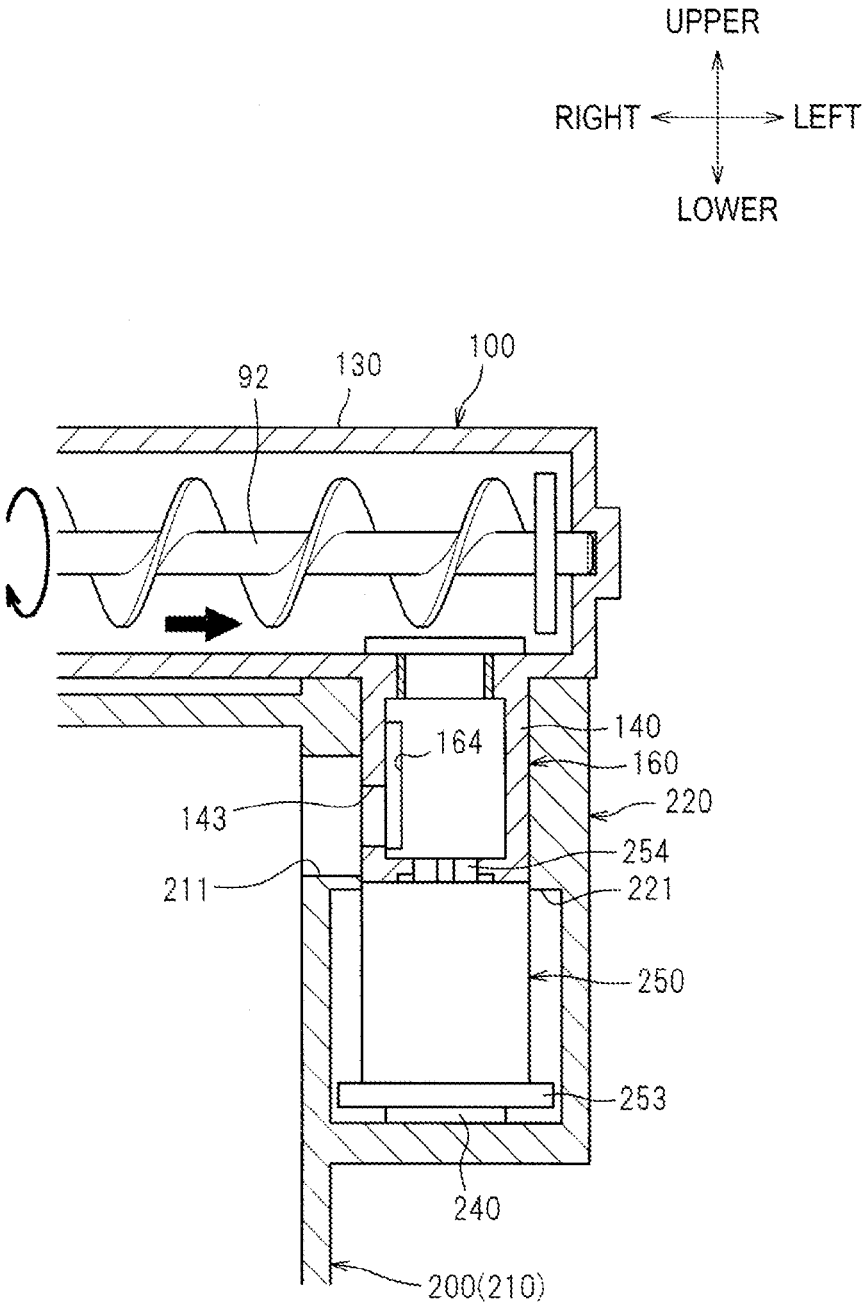
FIG. 10 is a sectional view showing a state where the first housing and the second housing communicate with each other.

Also, at this time, the pair of projections 256 (refer to FIG. 7B) of the second opening and closing member 250 is engaged into the guide recesses 241 of the protrusion part 240. When the second opening and closing member 250 is further moved downward, the projections 256 are moved along the guide recesses 241, so that the second opening and closing member 250 is rotated. Since the engaging part 254 is fitted into the recess portion 165, the first opening and closing member 160 is rotated together with the second opening and closing member 250, thereby opening the first opening 143, as shown in FIG. 10.

That is, when the holder 60 is moved from the separation position to the mounting position, the second opening and closing member 250 opens the second opening 211 before the first opening and closing member 160 opens the first opening 143. Therefore, when the first housing 100 and the second housing 200 communicate with each other, it is possible to immediately allow the toner which is discharged from the first opening 143 of the first housing 100 to flow into the second housing 200.

When the holder 60 is located at the mounting position, the first opening 143 and the second opening 211 oppose each other, so that the first housing 100 and the second housing 200 communicate with each other. Thereby, the toner collected by the blade 91 is conveyed to the first communication part 140 by the auger 92 and is accommodated in the waste toner accommodating part 210 through the first opening 143 and the second opening 211.

When moving the holder 60 from the mounting position to the separation position so as to draw the holder 60 out of the apparatus main body 10, the second housing 200 is moved downward. Thereby, the first communication part 140 is moved upward relative to the second communication part 220. Therefore, as shown in FIG. 9, the second opening and closing member 250 is also moved upward relative to the second communication part 220 by the urging force of the coil spring 260. At this time, the projections 256 are moved along the guide recesses 241, so that the second opening and closing member 250 and the first opening and closing member 160 are rotated and the first opening and closing member 160 closes the first opening 143.

When the second housing 200 is further moved downward, the second opening and closing member 250 is further moved upward relative to the second communication part 220, thereby closing the second opening 211.

That is, the first opening and closing member 160 and the second opening and closing member 250 close the first opening 143 and the second opening 211 while moving the holder 60 from the mounting position to the separation position. Therefore, when drawing the holder 60, the first opening 143 and the second opening 211 are closed, so that it is possible to prevent the collected toner from being leaked from the first housing 100 or the second housing 200.

Also, when moving the holder 60 from the mounting position to the separation position, the first opening and closing member 160 closes the first opening 143 and then the second opening and closing member 250 closes the second opening 211. Therefore, when the communication between the first housing 100 and the second housing 200 is released, the second opening 211 of the second housing 200 is opened until the first opening 143 of the first housing 100 is closed. Thus, even when the collected toner is leaked from the first opening 143, the second housing 200 can accommodate therein such toner.

After the first housing 100 and the second housing 200 are separated, the holder 60 is moved to the outer position. Thereby, it is possible to move the second housing 200 having the waste toner accommodating part 210 to the outside of the apparatus main body 10 while the first housing 100 which supports the blade 81 remains in the apparatus main body 10.

While the present invention has been shown and described with reference to certain illustrative embodiments thereof, it will be understood by those skilled in the art that various changes in form and details may be made therein without departing from the spirit and scope of the invention as defined by the appended claims.

In the above illustrative embodiment, the first housing 100 holds the blade 91 and the driven roller 72, and the blade 91 is provided to the member which holds the driven roller 72. However, the present invention is not limited thereto. For example, the driven roller 72 may be held to a member which is separately provided from the first housing 100.

Figure 11:
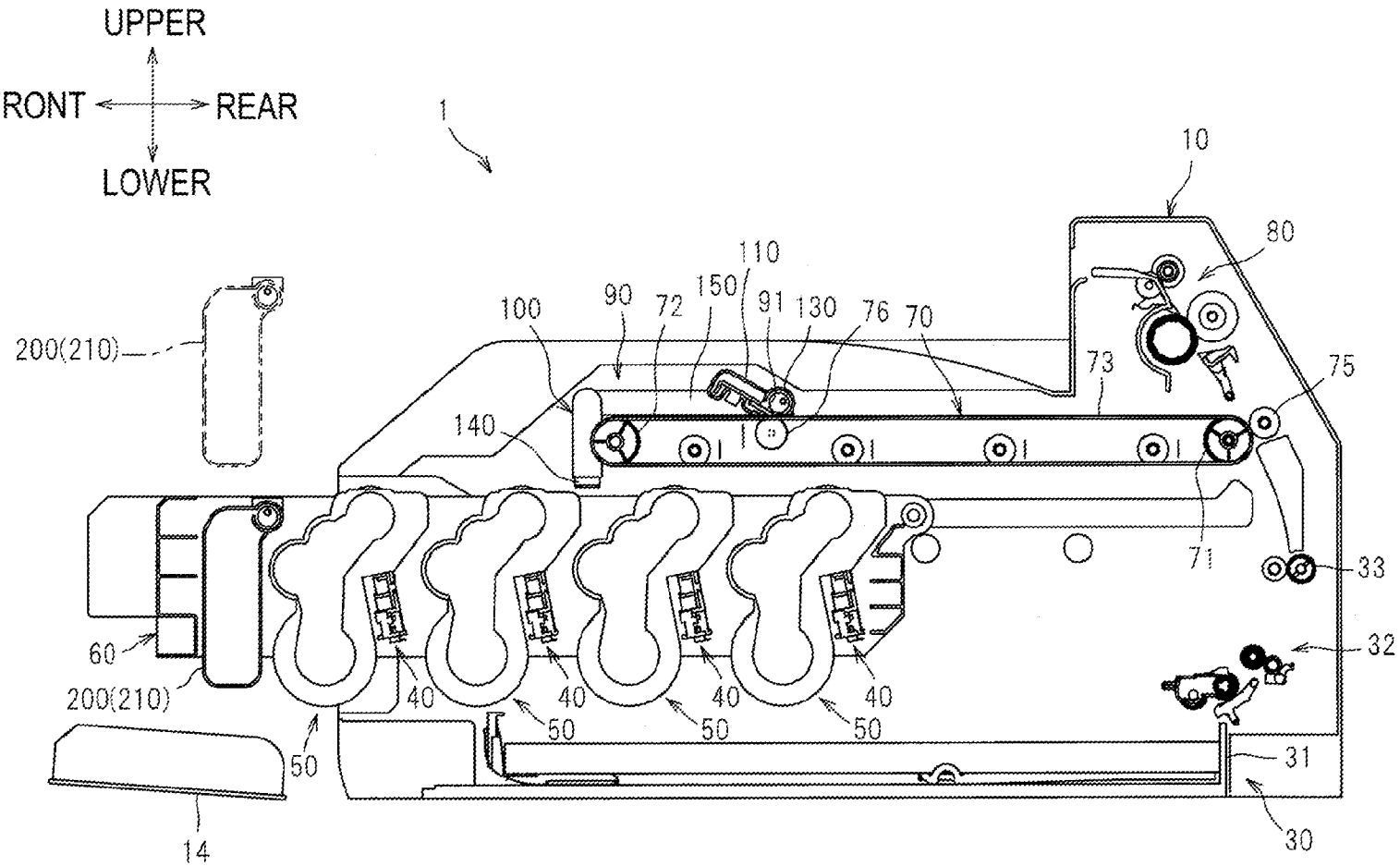
FIG. 11 shows a state where a holder is located at an outer position according to a first modified illustrative embodiment of the present invention.

Specifically, as shown in FIG. 11, the first housing 100 of the cleaning unit 90 has the blade holding part 110 and auger holding part 130 arranged above the endless belt 73, the first communication part 140 arranged at the front of the endless belt 73 and a connection part 150 enabling the auger holding part 130 and the first communication part 140 to communicate with each other.

The blade holding part 110 holds the blade 91 such that the blade opposes an upper extension surface of the endless belt 73. In this case, the transfer unit 70 may have a backup member 76 which sandwiches the endless belt 73 with a tip end of the blade 91.

The connection part 150 has a cylinder shape and is provided therein with a conveyance member such as auger such that toner scraped off by the blade 91 is conveyed toward the first communication part 140.

In the meantime, the driven roller 72 is separately provided from the first housing 100 and is rotatably supported by a member (not shown) which is supported to the apparatus main body 10.

According to this configuration, the blade 91 can collect toner from the endless belt 73, irrespective of the change in positions of the driving roller 71 and the driven roller 72. Thereby, since it is not necessary to move the blade 91 relative to the apparatus main body 10, it is easy to connect the first housing 100 and the second housing 200.

Further, in the above illustrative embodiment, the blade 91 is exemplified as the collecting member. However, the invention is not limited thereto. For example, a cleaning roller may be used as the collecting member.

Figure 12:
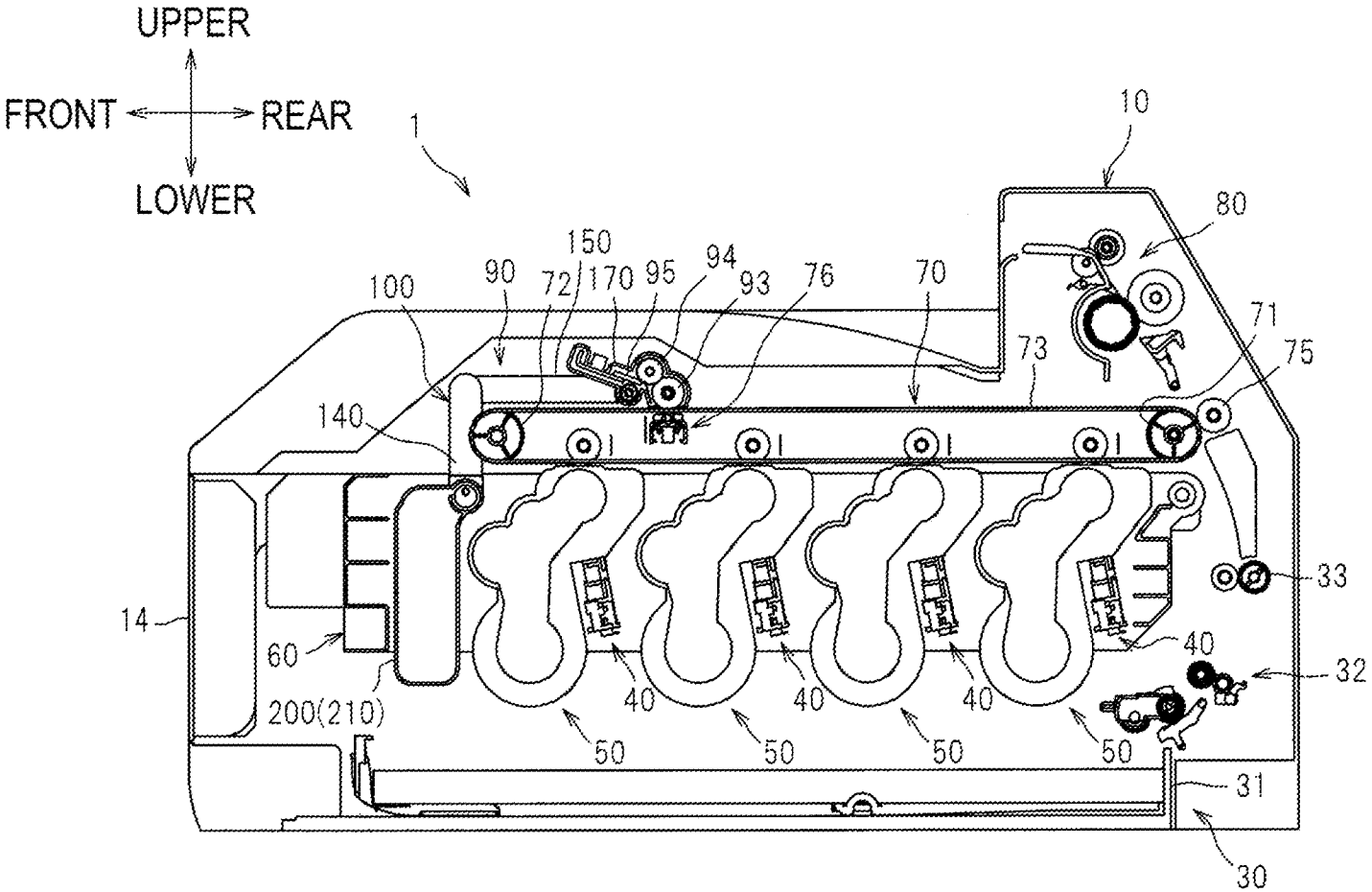
FIG. 12 is a sectional view showing a schematic configuration of a color printer according to a second modified illustrative embodiment of the present invention.

Specifically, an example in which a cleaning roller is used as the collecting member is described with reference to FIG. 12. The first housing 100 of the cleaning unit 90 has a roller holding part 170 which allows communication between the first communication part 140 and the connection part 150. The roller holding part 170 is provided with a cleaning roller 93, a collecting roller 94 and a scraping blade 95.

The cleaning roller 93 is provided to oppose the extension surface of the endless belt 73 at the upper of the endless belt 73 and is rotated as a driving force is input from a driving source (not shown) in the apparatus main body 10. The cleaning roller 93 positions the endless belt 73 between the cleaning roller 93 and a backup member 76 provided to the transfer unit 70. The cleaning roller 93 is applied with a bias having a reverse polarity to the charged polarity of the toner, so that it can collect the toner on the endless belt 73.

The collecting roller 94 is provided to oppose the cleaning roller 93 and is applied with a bias which has an absolute value larger than the bias applied to the cleaning roller 93 and a reverse polarity to the charged polarity of the toner. Thereby, the collecting roller 94 is configured to collect the toner collected by the cleaning roller 93.

The scraping blade 95 is configured to slidably contact the circumference of the collecting roller 94 and to thus scrape off the toner attached to the surface of the collecting roller 94. The toner scraped off by the scraping blade 95 is conveyed to the second housing 200 through the connection part 150 and the first communication part 140.

Further, the cleaning roller 93 may be arranged below the endless belt 73.

Figure 13:
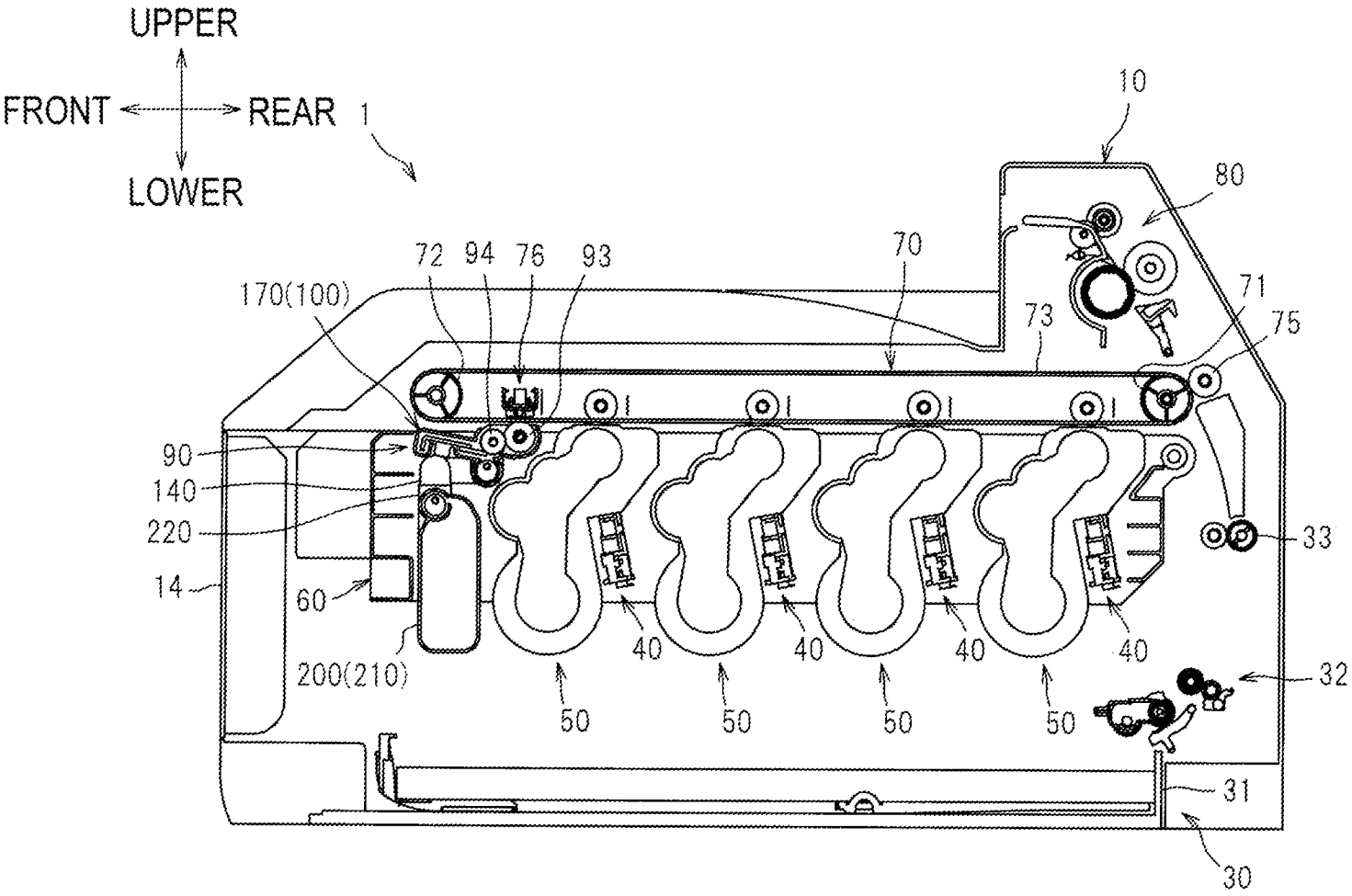
FIG. 13 is a sectional view showing a schematic configuration of a color printer according to a third modified illustrative embodiment of the present invention.

Specifically, an example in which the cleaning roller 93 is arranged below the endless belt 73 is described with reference to FIG. 13. The first housing 100 is arranged below the endless belt 73. When the holder 60 is located at the mounting position, the first communication part 140 and the second communication part 220 (first opening and second opening) are arranged inside the holder 60.

Figure 14:
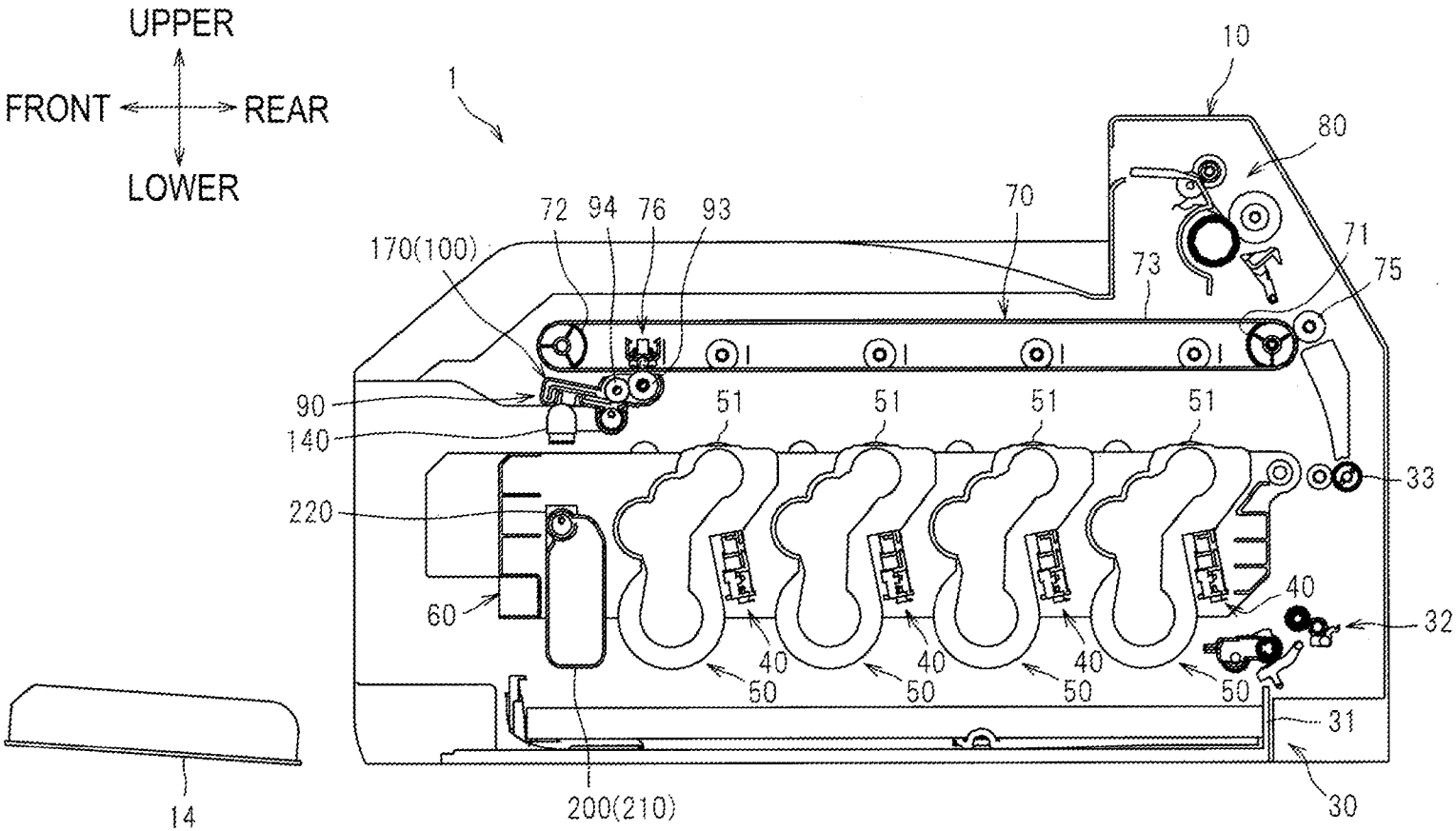
FIG. 14 shows a state where a holder is located at a separation position according to the third modified illustrative embodiment.

In the color printer 1 configured as described above, as shown in FIG. 14, when the holder 200 is located at the separation position, the upper end of the holder 60 and the upper ends of the photosensitive drums 51 are positioned below the lower end of the first housing 100. Thereby, when the holder 60 is moved from the separation position to the outer position, the first housing 100 does not interfere with the holder 60 or photosensitive drums 51.

Further, in the above illustrative embodiment, the plurality of photosensitive drums 51 are arranged to oppose the lower surface of the endless belt 73. However, the present invention is not limited thereto. For example, as shown in FIG. 15, the plurality of photosensitive drums 51 may be arranged to oppose the upper surface of the endless belt 73.

Specifically, an example of a color printer 1A in which the plurality of photosensitive drums 51 is arranged to oppose the upper surface of the endless belt 73 is described with reference to FIGS. 15 to 17.

Figure 15:
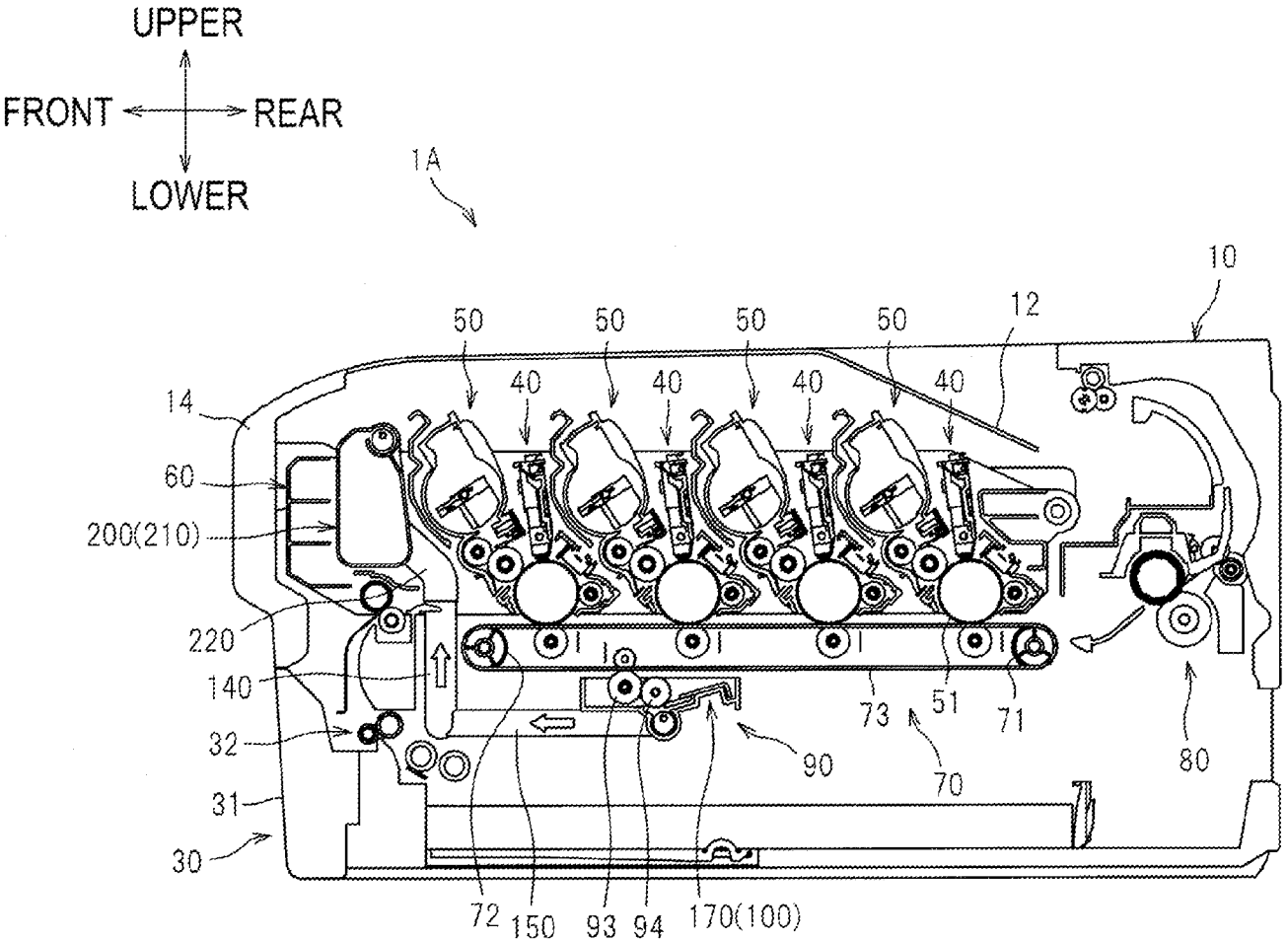
FIG. 15 is sectional view showing a schematic configuration of a color printer according to a fourth modified illustrative embodiment of the present invention.

As shown in FIG. 15, the plurality of photosensitive drums 51 is held to the holder 60 which is arranged above the endless belt 73. The holder 60 is configured to move to the mounting position (position shown in FIG. 15) at which the photosensitive drums 51 are mounted to the apparatus main body 10, to the separation position (position shown in FIG. 16) which is located at the inner side of the apparatus main body 10 and at which the photosensitive drums 51 are more spaced upward from the endless belt 73 than at the mounting position, and to the outer position (position shown in FIG. 17) which is located at the more outer side of the apparatus main body 10 than the separation position.

The sheet feeding mechanism 32 is configured to feed the sheet S between the photosensitive drums 51 and the endless belt 73.

When the holder 60 is located at the mounting position, the cleaning unit 90 is configured such that the first housing 100 is arranged below the second housing 200.

The first housing 100 has the roller holding part 170 having the cleaning roller 93 and the like, the first communication part 140 and the connection part 150.

The roller holding part 170 is arranged such that the cleaning roller 93 opposes the extension surface of the endless belt 73 at the lower of the transfer unit 70.

The connection part 150 extends forward from the roller holding part 170 along the endless belt 73 and then extends upward to pass to the front of the driven roller 72. The tip of the connection part 150 is provided with the first communication part 140. The first communication part 140 is provided with the second opening 211 and an opening and closing mechanism such as the second opening and closing member 250.

The second housing 200 is held to the holder 60 and has the waste toner accommodating part 210 and the second communication part 220. Also, as shown in FIG. 17, the second housing 200 can be separated from the holder 60 when the holder 60 is located at the outer position.

Referring to FIG. 15, the second communication part 220 extends downward from the waste toner accommodating part 210 to the upper of the first communication part 140 of the first housing 100, and the tip thereof is exposed through the bottom of the holder 60. The tip of the second communication part 220 is provided with the first opening 143 and an opening and closing mechanism such as the first opening and closing member 160. In the meantime, the second communication part 220 is provided therein with the conveyance member such as auger, so that the toner conveyed from the first housing 100 can be conveyed from the lower toward the upper (specifically, toward the inside of the waste toner accommodating part 210).

According to the cleaning unit 90 configured as described above, when the holder 60 is located at the mounting position, the first communication part 140 and the second communication part 220 communicate with each other, so that the toner collected from the endless belt 73 by the cleaning roller 93 can be conveyed to the waste toner accommodating part 210 through the first communication part 140 and the second communication part 220.

Figure 16:
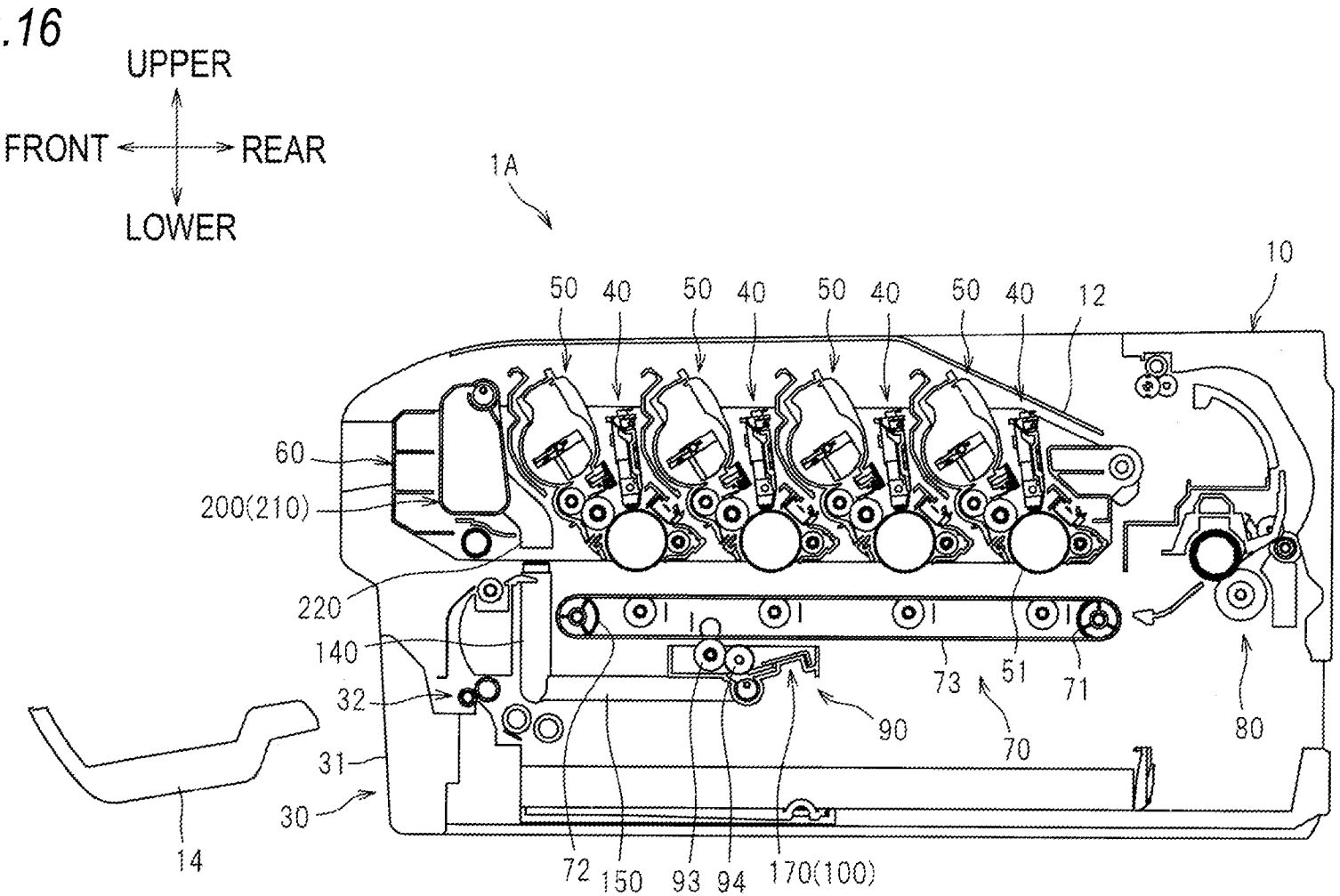
FIG. 16 shows a state where a holder is located at a separation position according to the fourth modified illustrative embodiment.
Figure 17:
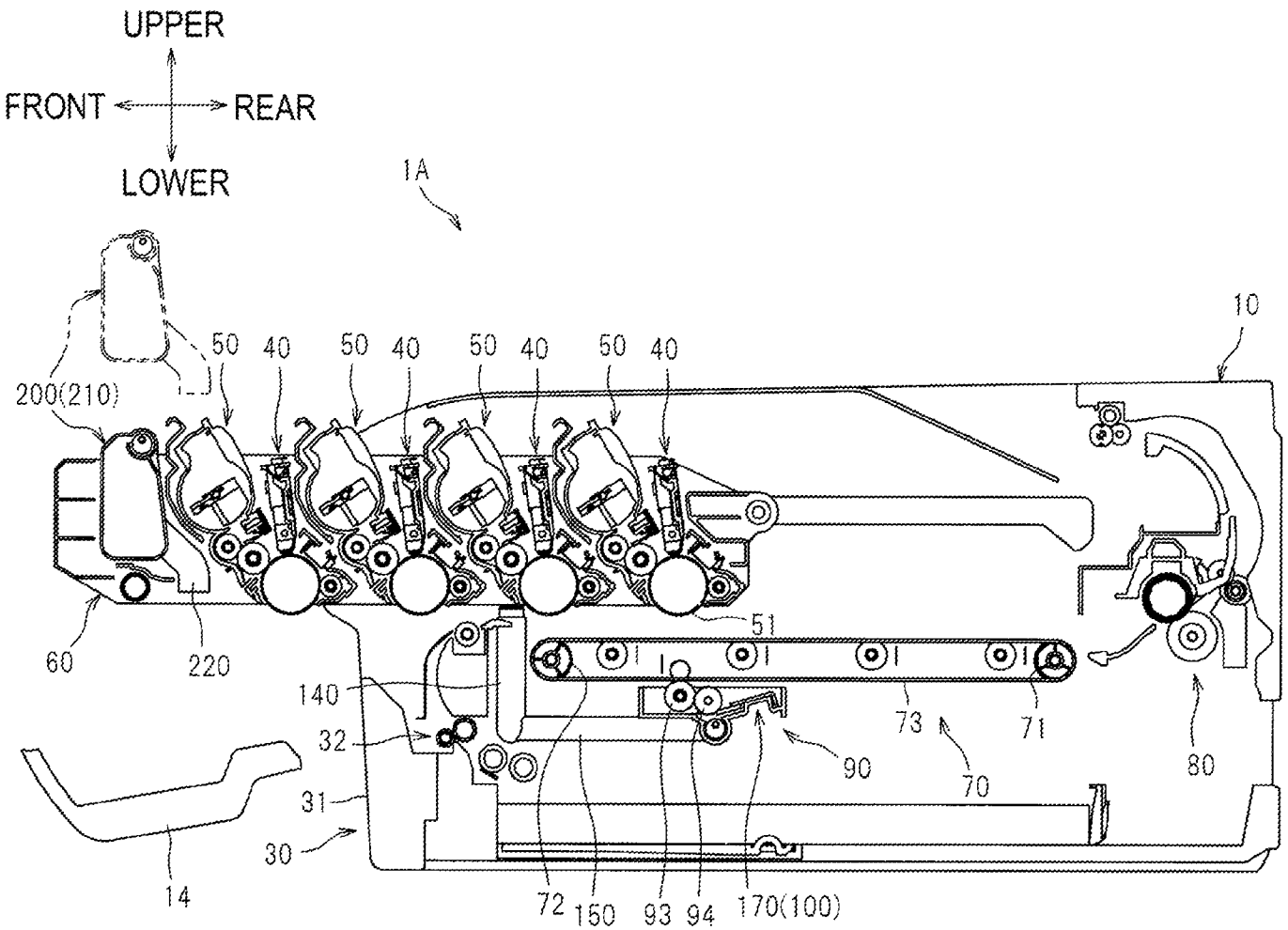
FIG. 17 shows a state where a holder is located at an outer position according to the fourth modified illustrative embodiment of the present invention.

Also, as shown in FIG. 16, while moving the holder 60 from the mounting position to the separation position, the second housing 200 is moved upward together with the holder 60, so that the connection of the first communication part 140 and the second communication part 220 is released.

Also, when the holder 60 is moved from the separation position to the mounting position, the second housing 200 is moved downward together with the holder 60, so that the first communication part 140 and the second communication part 220 are connected.

Figure 18:
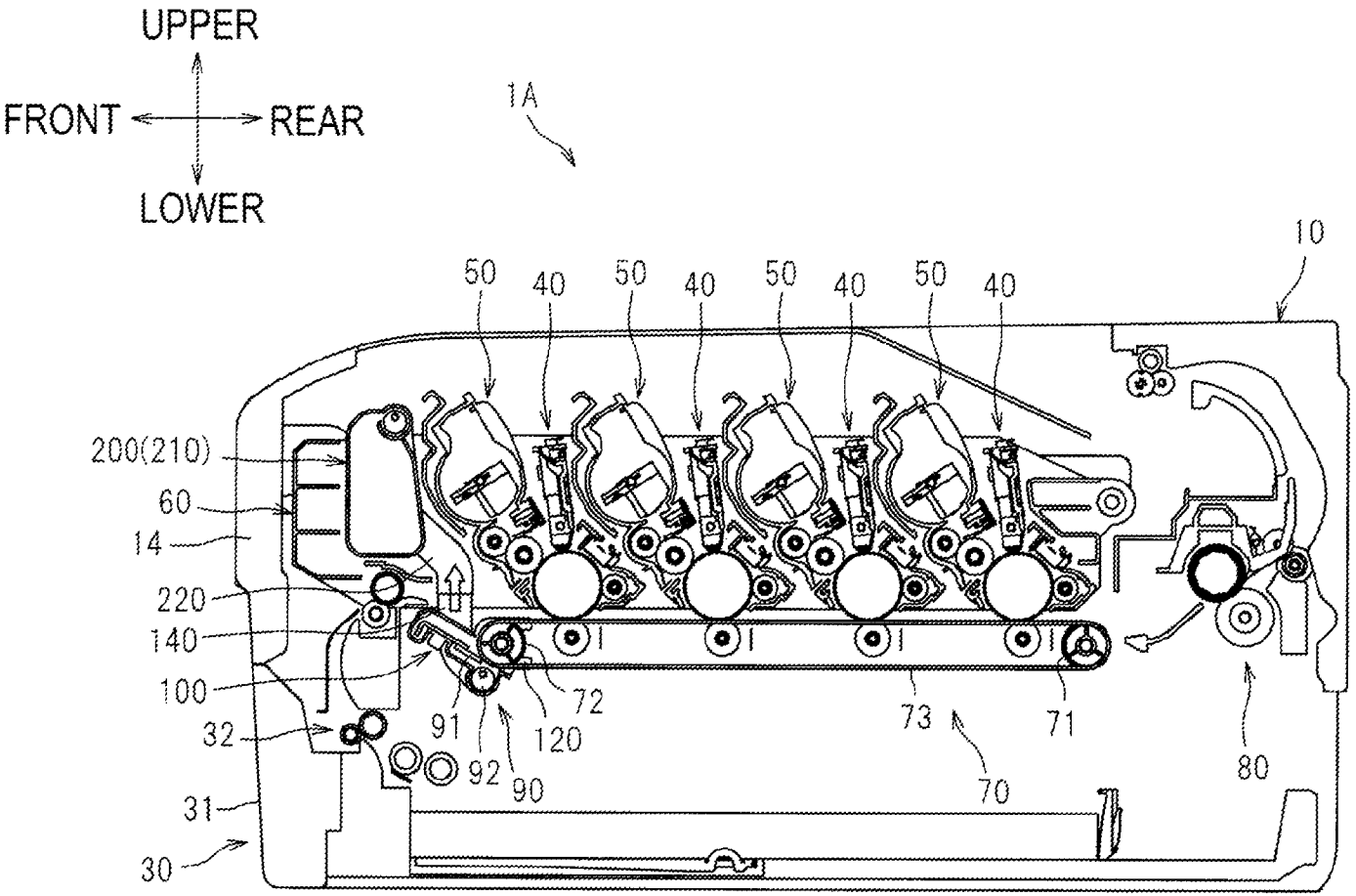
FIG. 18 is sectional view showing a schematic configuration of a color printer according to a fifth modified illustrative embodiment of the present invention.

In the meantime, also in the color printer 1A in which the plurality of photosensitive drums opposes the upper surface of the endless belt, as shown in FIG. 18, the collecting member may be the blade 91 and the blade 91 may be provided to the first housing 100 having the driven roller holding part 120 which holds the driven roller 72.

In the above illustrative embodiment, the first opening and closing member 160 and the second opening and closing member 250 are configured such that the second opening and closing member 250 opens the second opening 211, and thereafter, the first opening and closing member 160 opens the first opening 143 when the holder 60 is moved from the separation position to the mounting position. However, the present invention is not limited thereto. For example, the first opening and closing member and the second opening and closing member may be configured such that the second opening and closing member starts to open the second opening, and then, the first opening and closing member starts to open the first opening. Alternatively, the first opening and closing member and the second opening and closing member may be configured such that the first opening and closing member opens the first opening at the same time as the second opening and closing member opens the second opening.

In the above illustrative embodiment, the first opening and closing member 160 and the second opening and closing member 250 are configured such that the first opening and closing member 160 closes the first opening 143, and thereafter, the second opening and closing member 250 opens the second opening 211 when the holder 60 is moved from the mounting position to the separation position. However, the present invention is not limited thereto. For example, the first opening and closing member and the second opening and closing member may be configured such that the second opening and closing member closes the second opening while the first opening and closing member starts to close the first opening and then completely closes the first opening. Alternatively, the first opening and closing member and the second opening and closing member may be configured such that the second opening and closing member closes the second opening at the same time as the first opening and closing member closes the first opening.

In the above illustrative embodiment, the color printer 1 is illustrated. However, the present invention is not limited thereto. For example, the inventive concept of the present invention may be applied to other image forming apparatuses such as copier, complex machine and the like.

In the above illustrative embodiment, the holder 60 holds the process cartridges 50 that have the photosensitive drum 51, respectively. However, the present invention is not limited thereto. For example, the holder may hold both developing cartridges and the respective photosensitive drums such that the developing cartridges are detachable to the holder and the photosensitive drums and the holder can be replaced collectively.

The invention claimed is:

1. An image forming apparatus configured to form an image by using a plurality of photosensitive drums, the image forming apparatus comprising:

an apparatus main body;

a first roller;

a second roller spaced from the first roller and urged in a direction separating from the first roller;

an endless belt which is provided in the apparatus main body and is wound around the first roller and the second roller;

a drawing member which is configured to support a plurality of cartridges, and is movable among a mounting position at which the drawing member is mounted in the apparatus main body and the plurality of photosensitive drums oppose the endless belt, a separation position which is located at an inner side of the apparatus main body and at which the photosensitive drums are more spaced from the endless belt than at the mounting position, and an outer position which is located at an outer side of the apparatus main body; and a cleaning unit including:

a collecting member which is configured to contact the endless belt to collect developer on the endless belt; and an accommodating part which is configured to accommodate the developer collected by the collecting member, wherein the cleaning unit includes a first housing having the collecting member and a second housing having the accommodating part, wherein the first housing is provided to the apparatus main body, the first housing including a first opening, wherein the second housing is provided to the drawing member and includes a second opening, the second opening being configured to move between a first position opposing the first opening to allow the first housing and the second housing to communicate with each other when the drawing member is located at the mounting position and a second position being separated from the first opening when the drawing member is located at the separation position, and wherein the first opening is positioned above the second opening when the second opening is located at the second position.

2. The image forming apparatus according to claim 1, wherein the first opening is positioned below a lower surface of the endless belt.

3. The image forming apparatus according to claim 1, wherein the second opening is positioned below an upper surface of the photosensitive drums.

4. The image forming apparatus according to claim 1, wherein the collecting member is provided to a member which holds the second roller.

5. The image forming apparatus according to claim 1, wherein the collecting member is provided to sandwich the endless belt with the second roller.

6. The image forming apparatus according to claim 1, wherein the first housing includes a first opening and closing member which is configured to open and close the first opening.

7. The image forming apparatus according to claim 1, wherein the second housing includes a second opening and closing member which is configured to open and close the second opening.

8. The image forming apparatus according to claim 1, wherein the first housing includes a first opening and closing member which is configured to open and close the first opening, wherein the second housing includes a second opening and closing member which is configured to open and close the second opening, and wherein when the drawing member is moved from the separation position to the mounting position, the second opening and closing member opens the second opening before the first opening and closing member opens the first opening.

9. The image forming apparatus according to claim 1, wherein the first housing includes a first opening and closing member which is configured to open and close the first opening, wherein the second housing includes a second opening and closing member which is configured to open and close the second opening, and wherein when the drawing member is moved from the mounting position to the separation position, the second opening and closing member closes the second opening after the first opening and closing member closes the first opening.

10. An image forming apparatus configured to form an image by using a plurality of photosensitive drums, the image forming apparatus comprising:

an apparatus main body;

a first roller;

a second roller spaced from the first roller and urged in a direction separating from the first roller;

an endless belt which is provided in the apparatus main body and is wound around the first roller and the second roller;

a drawing member which is configured to support a plurality of cartridges, and is movable among a mounting position at which the drawing member is mounted in the apparatus main body and the plurality of photosensitive drums oppose the endless belt, a separation position which is located at an inner side of the apparatus main body and at which the photosensitive drums are more spaced from the endless belt than at the mounting position, and an outer position which is located at an outer side of the apparatus main body; and a cleaning unit including:

a collecting member which is configured to contact the endless belt to collect developer on the endless belt; and an accommodating part which is configured to accommodate the developer collected by the collecting member, wherein the cleaning unit includes a first housing having the collecting member and a second housing having the accommodating part, wherein the collecting member is provided to sandwich the endless belt with the second roller, wherein the first housing is provided to the apparatus main body, the first housing including a first opening, and wherein the second housing is provided to the drawing member and includes a second opening, the second opening being configured to move between a first position opposing the first opening to allow the first housing and the second housing to communicate with each other when the drawing member is located at the mounting position and a second position being separated from the first opening when the drawing member is located at the separation position.

11. The image forming apparatus according to claim 10, wherein the first opening is positioned below a lower surface of the endless belt.

12. The image forming apparatus according to claim 10, wherein the second opening is positioned below an upper surface of the photosensitive drums.

13. The image forming apparatus according to claim 10, wherein the first housing includes a first opening and closing member which is configured to open and close the first opening.

14. The image forming apparatus according to claim 10, wherein the second housing includes a second opening and closing member which is configured to open and close the second opening.

15. The image forming apparatus according to claim 10, wherein the first housing includes a first opening and closing member which is configured to open and close the first opening, wherein the second housing includes a second opening and closing member which is configured to open and close the second opening, and wherein when the drawing member is moved from the separation position to the mounting position, the second opening and closing member opens the second opening before the first opening and closing member opens the first opening.

16. The image forming apparatus according to claim 10, wherein the first housing includes a first opening and closing member which is configured to open and close the first opening, wherein the second housing includes a second opening and closing member which is configured to open and close the second opening, and wherein when the drawing member is moved from the mounting position to the separation position, the second opening and closing member closes the second opening after the first opening and closing member closes the first opening.

17. An image forming apparatus configured to form an image by using a plurality of photosensitive drums, the image forming apparatus comprising:

an apparatus main body;

a first roller;

a second roller spaced from the first roller and urged in a direction separating from the first roller;

an endless belt which is provided in the apparatus main body and is wound around the first roller and the second roller;

a drawing member which is configured to support a plurality of cartridges, and is movable among a mounting position at which the drawing member is mounted in the apparatus main body and the plurality of photosensitive drums oppose the endless belt, a separation position which is located at an inner side of the apparatus main body and at which the photosensitive drums are more spaced from the endless belt than at the mounting position, and an outer position which is located at an outer side of the apparatus main body; and a cleaning unit including:

a collecting member which is configured to contact the endless belt to collect developer on the endless belt; and an accommodating part which is configured to accommodate the developer collected by the collecting member, wherein the cleaning unit includes a first housing having the collecting member and a second housing having the accommodating part, wherein the first housing is provided to the apparatus main body, the first housing including a first opening, and wherein the second housing is provided to the drawing member and includes a second opening, the second opening being configured to move between a first position opposing the first opening to allow the first housing and the second housing to communicate with each other when the drawing member is located at the mounting position and a second position being separated from the first opening when the drawing member is located at the separation position, wherein the first housing includes a first opening and closing member which is configured to open and close the first opening, wherein the second housing includes a second opening and closing member which is configured to open and close the second opening, and wherein when the drawing member is moved from the separation position to the mounting position, the second opening and closing member opens the second opening before the first opening and closing member opens the first opening.

18. The image forming apparatus according to claim 17, wherein the first opening is positioned below a lower surface of the endless belt.

19. The image forming apparatus according to claim 17, wherein the second opening is positioned below an upper surface of the photosensitive drums.

20. The image forming apparatus according to claim 17, wherein the collecting member is provided to a member which holds the second roller.

* * * * *